US007338232B2

(12) United States Patent
Nasr

(10) Patent No.: US 7,338,232 B2
(45) Date of Patent: Mar. 4, 2008

(54) METHOD FOR INSTALLING A SCREW PILE

(76) Inventor: Mamdouh A. Nasr, 513, 10311 - 111 Street, Edmonton, Alberta (CA) T5K 2Y8

( * ) Notice: Subject to any disclaimer, the term of this patent is extended or adjusted under 35 U.S.C. 154(b) by 0 days.

(21) Appl. No.: 11/462,766

(22) Filed: Aug. 7, 2006

(65) Prior Publication Data

US 2008/0031695 A1 Feb. 7, 2008

(51) Int. Cl.
*E02D 7/00* (2006.01)

(52) U.S. Cl. ..... 405/233; 405/241; 405/252.1

(58) Field of Classification Search ..... 405/231, 405/232, 233, 236, 240, 241, 249, 252.1, 405/253, 254

See application file for complete search history.

(56) References Cited

U.S. PATENT DOCUMENTS 3,206,936 A * 9/1965 Moor ..... 405/241
4,533,279 A * 8/1985 van den Elzen et al. ... 405/239
5,304,016 A * 4/1994 Kunito ..... 405/233
5,575,593 A 11/1996 Raaf
5,707,180 A 1/1998 Vickars et al.
5,919,005 A * 7/1999 Rupiper ..... 405/244
5,934,836 A * 8/1999 Rupiper et al. ..... 405/244

FOREIGN PATENT DOCUMENTS

JP 60156821 A * 8/1985
JP 01039416 A * 2/1989

* cited by examiner

*Primary Examiner*—Frederick L. Lagman
(74) *Attorney, Agent, or Firm*—Sheridan Ross P.C.

(57) ABSTRACT

A screw pile is equipped with internal grout pipes extending downwardly through the bore of the tubular pile shaft. The grout pipes connect with side-opening ports in the shaft side wall, to form conduits through which fluid grout may be injected into the surrounding ground. The grout is injected at high pressure as the pile is rotatively driven into a subsurface target formation in which the pile is to be landed. In this way, the grout is distributed along a vertical interval of formation. It has been shown that this technique is characterized by increased load capacities of the implanted pile, relative to piles implanted without grouting or with grouting but only at landed depth.

3 Claims, 5 Drawing Sheets

METHOD FOR INSTALLING A SCREW PILE

FIELD OF THE INVENTION

The present invention relates to a screw pile and to a method for installing it in conjunction with injection of grout.

BACKGROUND OF THE INVENTION

Screw piles have long been commonly used in connection with foundation underpinning, pipeline tie-downs and in other applications.

In one known embodiment, the screw pile comprises:

an open ended tubular shaft having one or more helixes externally mounted thereon adjacent its pointed lower end;

the shaft usually comprises a bottom anchor section carrying the helixes and one or more extension sections;

the shaft has means, such as pin holes, at its upper end, for insertion of locking pins to connect the shaft with a drive head assembly which functions to rotate the pile into the ground.

A screw pile will be characterized by load-carrying and lateral deflection capacities, once implanted in the ground.

The load-carrying capacity of a screw pile can be increased by increasing its length and/or diameter or increasing the number of helixes. However these changes will require that greater torque be applied by the drive head assembly in order to rotate the pile into place at the desired landed depth. There are finite limits on the amount of torque that can be applied to the pile and on the capability of the drive head assembly to deliver it.

In addition, the nature of the ground into which the pile is implanted will also affect the load-carrying capacity of the pile.

It is known to inject grout, such as cement slurry, at low pressure, down through the bore of the hollow shaft and out, through ports in its side wall, into the sub-surface formation or stratum in which the pile has been landed, to thereby increase the stiffness of the formation and enhance the load capacities of the pile.

The present invention is concerned in one aspect with providing a modified screw pile and in another aspect with providing a method of installation, which have the objective of increasing the load capacities of an implanted pile.

SUMMARY OF THE INVENTION

In a preferred embodiment, a screw pile is provided having one or more internal grout pipes extending down into the bore of the tubular shaft. Each grout pipe is connected at its lower end with a side-opening port extending through the shaft side wall. The grout pipe and port combine to provide a grout conduit. The grout conduits each have a small diameter selected with the objective of promoting high pressure grout injection—that is, injection at a pressure greater than about 200 psi. The ports are suitably located so that, when the pile is at landed depth, the ports will be positioned opposite a target formation into which the grout has been injected.

In an alternative embodiment, a small diameter shaft, having side-opening ports in its lower end, can be used. The grout is injected into the target formation at high pressure through the bore of the shaft and the ports.

In the course of installation, grout is injected as the pile is being rotated into the target formation, to thereby distribute the grout through a vertical interval of the formation.

By combining high pressure grout injection and injecting while rotating the pile into the target formation, it has been demonstrated that the load capacities of the screw pile may be increased relative to a non-grouted pile and relative to a pile which has been grouted, but only when stationary and in place at total depth.

In one aspect, the invention is therefore concerned with a method for installing a load-bearing pile in the ground, comprising: providing a screw pile comprising a tubular shaft having a side wall forming an internal longitudinal bore, the side wall having a lower end portion carrying at least one externally mounted helix, the end portion forming at least one side-opening port extending therethrough; rotationally driving the screw pile into the ground to penetrate a sub-surface formation in which the end portion is to be landed at a total depth; and injecting grout into the formation through the shaft and ports at high pressure as the screw pile is rotated into the formation.

DESCRIPTION OF THE PREFERRED EMBODIMENT

Figure 1:
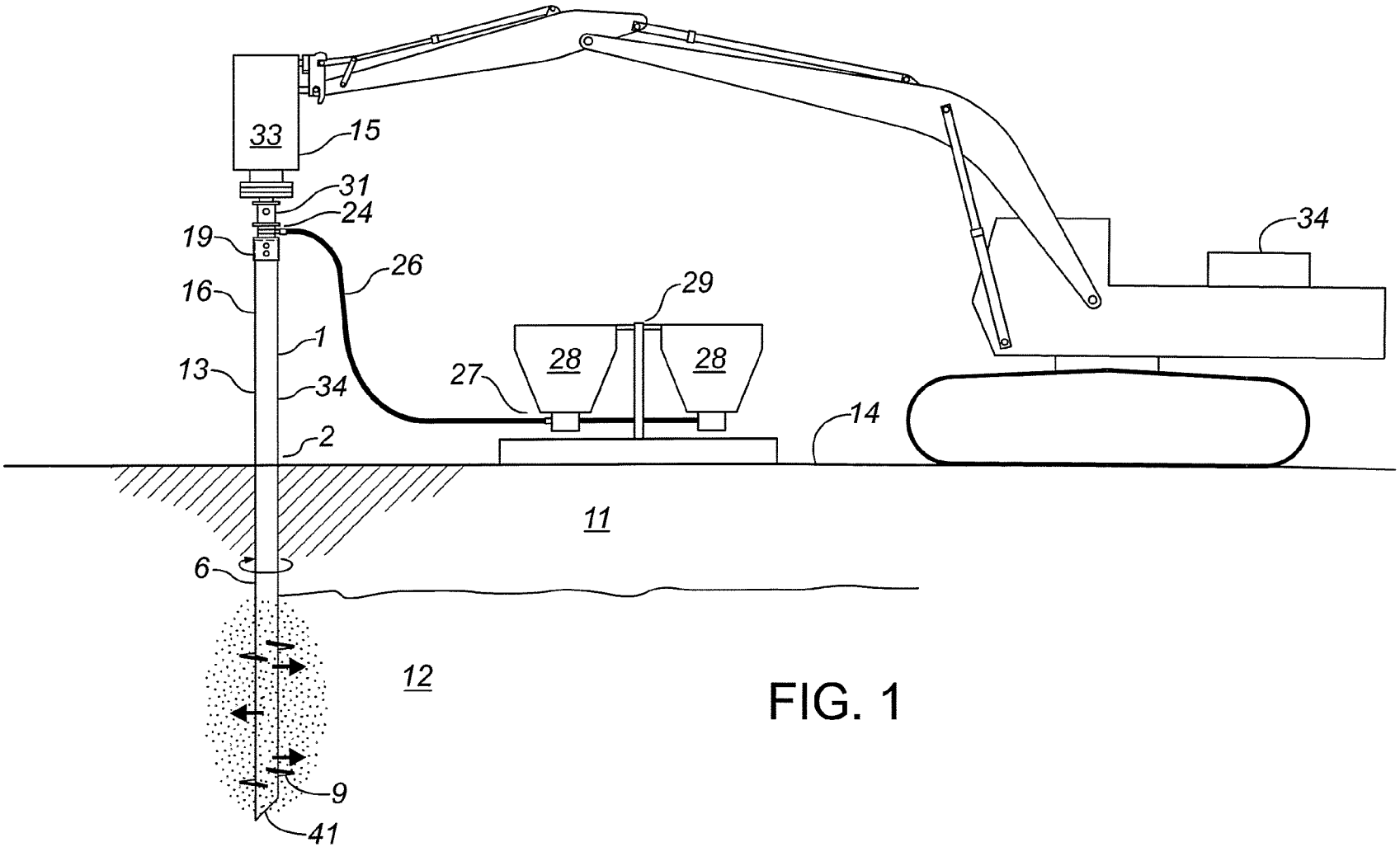
FIG. 1 is a side view showing a screw pile, having internal grout pipes, being rotatively driven into a sub-surface ground formation with concomitant grout injection.
Figure 2:
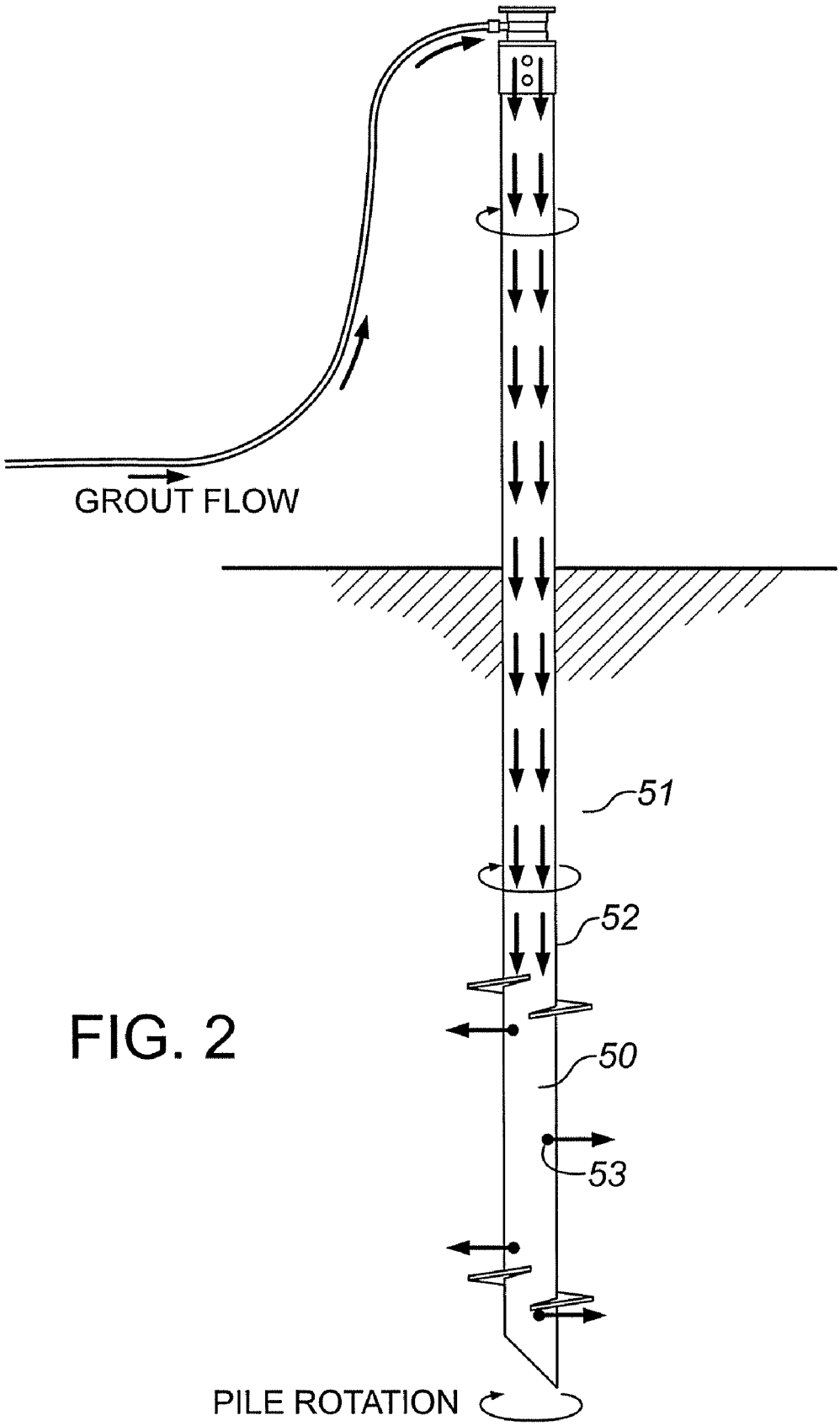
FIG. 2 is a side view showing grout being injected into the ground formation in the course of rotating a small diameter screw pile into the formation.
Figure 3:
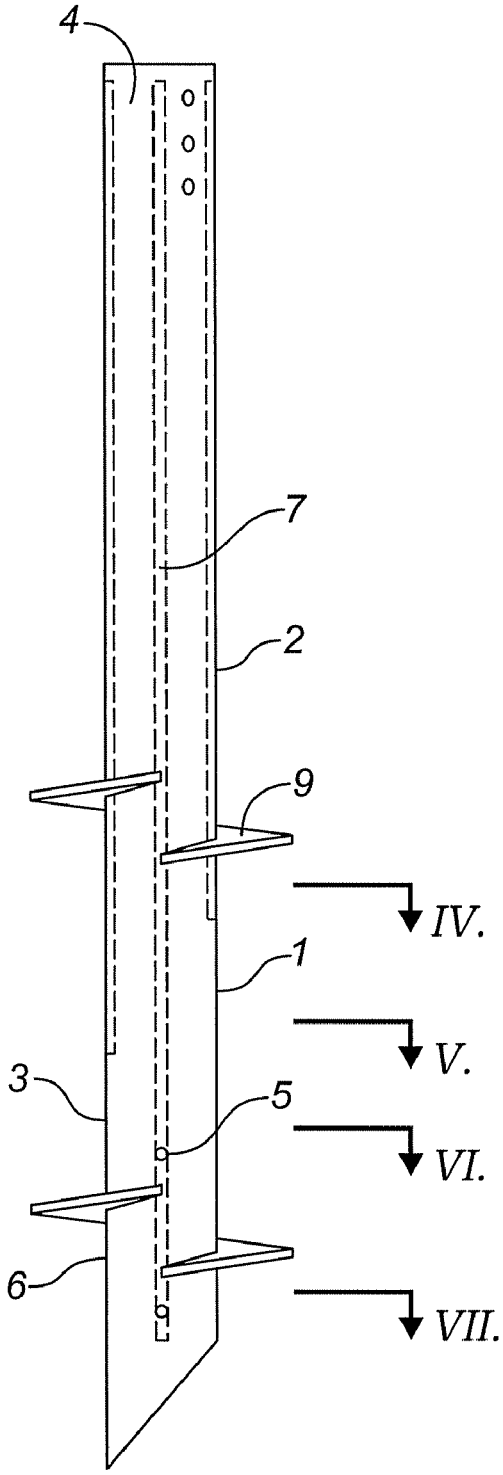
FIG. 3 is a side view of a 10¾" diameter screw pile equipped with ½" diameter internal grout conduits terminating at different elevations along the length of the shaft.
Figure 4:
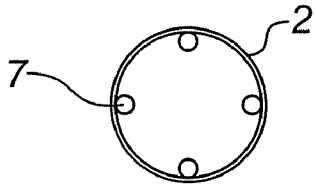
FIGS. 4, 5, 6 and 7 are sectional views of the screw pile of FIG. 3, taken at different elevations along the shaft.
Figure 5:
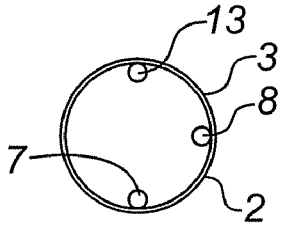
Figure 6:
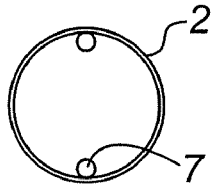
Figure 7:
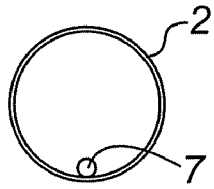

Having reference to FIG. 3, a modified, large diameter screw pile 1 is shown.

The screw pile 1 comprises an open-ended tubular steel shaft 2 whose side wall 3 forms an internal bore 4 extending longitudinally therethrough. The shaft side wall 3 further forms side-opening ports 5 at spaced intervals along the length of the lower end section 6 of the shaft 2.

A plurality of small diameter grout pipes 7 extend down through the bore 4 and connect with the ports 5 to form internal grout conduits 8.

By way of example, the shaft 2 and grout conduits 8 may have diameters of 10¾" and ½ " respectively.

A plurality of helixes 9 are externally mounted to the lower section 6 of the shaft 2.

The shaft 2 may include one or more upwardly extending, tubular extensions 34 connected with the lower end section 6.

The shaft 2 and helixes 9 combine to form a screw pile that can be rotatively screwed into the ground 11 to land the lower end section 6 in a subterranean target formation 12. The implanted screw pile 1 then serves to support and/or anchor an applied load.

The grout conduits 8 provide sealed passageways 13 through which streams of grout may be pumped at high pressure (preferably at least 200 psi) by grout pump assembly 29 from ground surface 14, thereby injecting the grout into the target formation 12.

Figure 9:
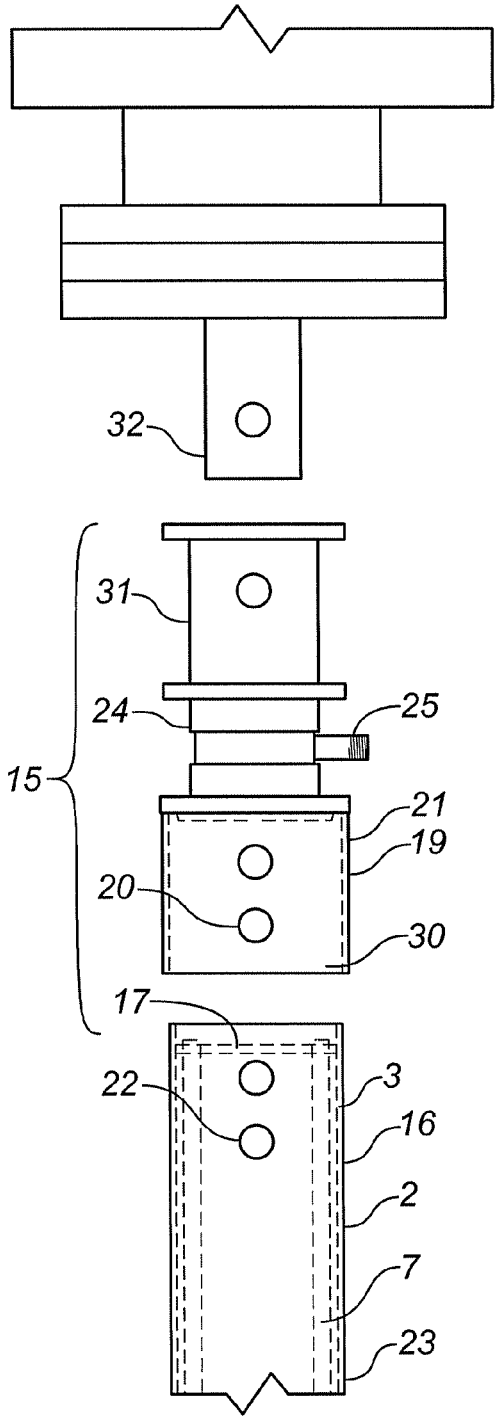
FIG. 9 is a side view showing a drive kelly, a head assembly and the upper end of the screw pile.
Figure 10:
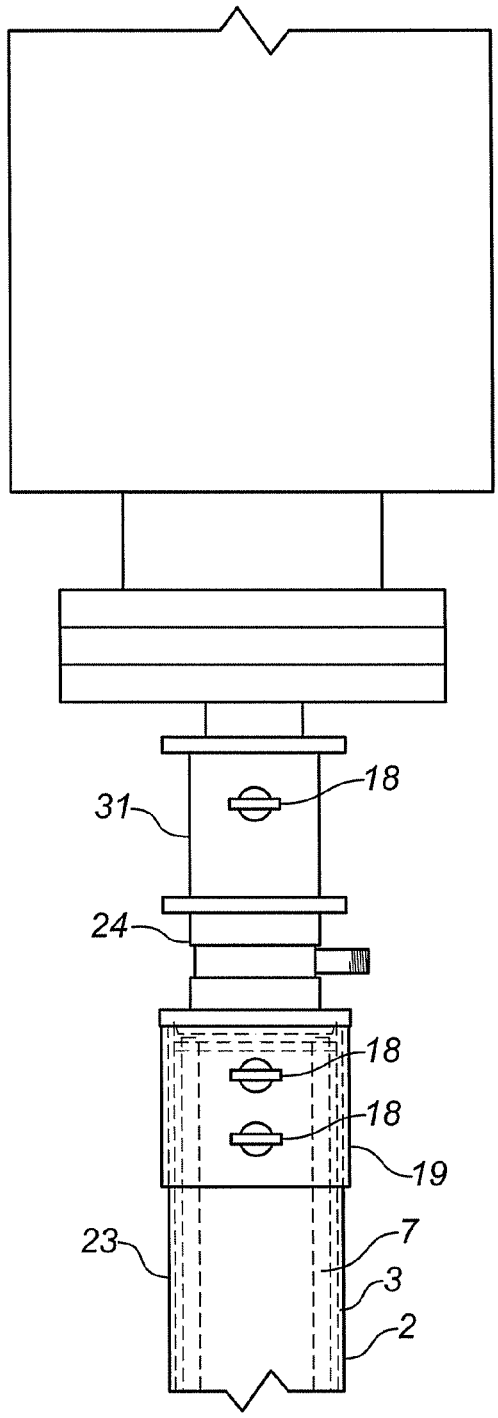
FIG. 10 is similar to FIG. 9, showing the components connected.

Having reference to FIGS. 9 and 10, a head assembly 15 is provided for attachment to the top end 16 of the shaft side wall 3.

The head assembly 15 comprises an apertured bulkhead plate 17, positioned in the top end 16 of the shaft bore 4. The bulkhead plate 17 receives the upper ends of the internal grout pipes 7 and seals around them and between them and the shaft side wall 3.

The head assembly 15 further comprises an open-bottomed, tubular drive can 19. The drive can 19 is adapted to slide over the top end 16 of the shaft side wall 3. The drive can 19 has pin holes 20 extending through its side wall 21 for registering with pin holes 22 formed through the top end 16 of the shaft side wall 3. Drive pins 18 may be inserted into the holes 22, 20 to lock the drive can 19 to the shaft top end 16. The drive can 19 comprises internal O-rings (not shown) for sealing against the outer surface 23 of the shaft 2.

The head assembly 15 also includes a swivel 24, connected with the upper end of the drive can 19. The swivel 24 has an inlet 25 for connection with a hose 26 and grout pump 27. The grout pump 27, mixing tanks 28 and hose 26 provide an assembly 29 for supplying cement grout, pumped at high pressure. The swivel 24 enables the grout to enter the internal chamber 30 of the drive can 19 from the stationary hose 26, when the drive can is rotating.

The head assembly 15 further comprises a kelly adapter 31 connected to the swivel 24. The kelly adapter 31 is connectable with the kelly joint 32 of a conventional drive head 33 which functions to rotatively drive the drive can 19 and screw pile 1. The drive head 33 is shown attached to the boom of a mobile installation unit 34.

In the method for installing the screw pile 1, the following steps are practised:

the drive head 33 is connected to the kelly adapter 31 and the hose 26 of the grout supply assembly 29 is connected to the grout inlet 25 of the swivel 24;

the drive head 33 is actuated to rotate the screw pile 1 into the ground 11;

when the bottom 41 of the rotating shaft 2 begins to penetrate the interval of formation 12 to be stiffened, the grout supply assembly 29 is activated to begin injecting grout through the grout conduits 8 at a pumping pressure greater than 200 psi; and high pressure grout injection, while rotating the screw pile 1, is continued until the pile approaches landed depth, at which point injection is terminated.

Figure 8:
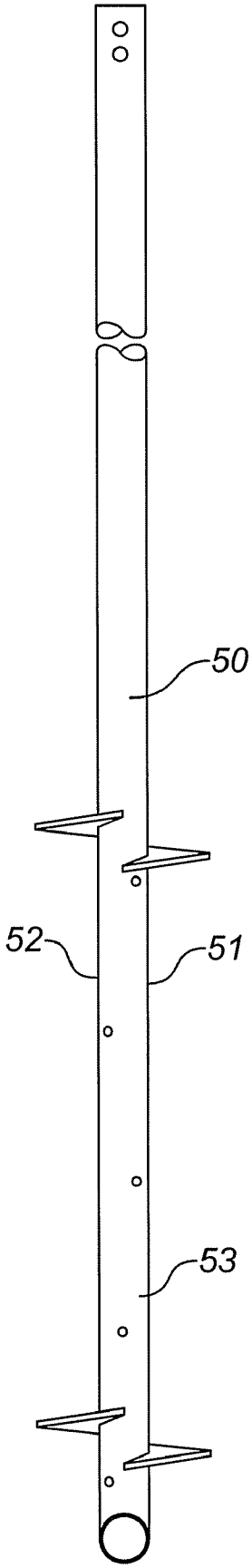
FIG. 8 is a side view of a 3½" diameter screw pile having side-opening ports.

In an alternative embodiment, the invention may be practised by injecting the grout at high pressure through the bore 50 of a rotating, small diameter (e.g. 3½" diameter) screw pile 51 (shown in FIG. 8). In this case, the shaft 52 of the pile 51 has only side-opening ports 53.

COMPARATIVE EXAMPLE

This example demonstrates the benefit in pile load capacity obtained by injecting grout at high pressure while rotating a screw pile into the ground.

Three screw piles A, B and C were prepared as follows:

Pile A had a shaft diameter of 10.75 inches and two externally mounted, 20 inch helices spaced 60 inches apart. The pile had a length of 20 feet. Pile A had no internal grout conduits;

Piles B and C were identical to pile A but each of B and C had four ½ inch grout conduits installed inside the shaft. The ports of the grout conduits were located between the helices at 12 inch intervals;

All three piles were rotated into place and landed 18 feet beneath ground surface by applying torque of 144,000 ft-lbs;

Pile A was installed without grouting. Pile B was grouted separately through each grout conduit, once the pile was landed at total depth of 18 feet by injecting Chem Grout 60™ (a cement grout) at a pumping pressure of about 300 psi. Pile C was rotated to a depth of 10 feet and then the same type of grout was simultaneously injected through the four grout conduits as the pile was rotated to total depth of 18 feet. The pumping pressure was maintained at about 200 psi during the installation of the last 8 feet of pile;

The three piles A, B and C were tested to failure (1 inch of settling) for a compressive load capacity, according to the ASTM D 1143 test, commencing one week after installation;

The non-grouted pile A failed at 400 kN; grouted pile B failed at 650 kN; and grouted pile C failed at 800 kN;

In addition the three piles were tested for lateral load capacities according to the ASTM D 3966-81 test. For a pile lateral movement of 15 mm, pile A required 50 kN, pile B required 80 kN and pile C required 120 kN.

What is claimed is:

1. A method for installing a load-bearing pile in the ground, comprising:

providing a screw pile comprising a tubular shaft having a side wall forming an internal longitudinal bore, the side wall having a lower end portion carrying at least one externally mounted helix, the lower end portion forming at least one side-opening port extending therethrough;

providing a head assembly connected to an upper end of the screw pile, the head assembling having a swivel;

rotationally driving the screw pile into the ground to penetrate a sub-surface formation in which the end portion is to be landed at a total depth;

injecting grout into the formation through a hose connected to the swivel and then through the shaft and ports at high pressure as the screw pile is rotated into the formation wherein the hose remains stationary, and wherein:

the shaft has a plurality of internal pipes extending into the bore from its upper end, the lower end portion forms a plurality of side-opening ports which are spaced apart along said lower end portion, the internal pipes are connected with the ports to form a plurality of grout conduits; and comprising:

injecting grout into the formation through each grout conduit at high pressure as the screw pile is rotated into the formation.

2. The method as set forth in claim 1 wherein the grout is a cement slurry injected through the bore at a pressure of at least 200 psi.

3. The method as set forth in claim 1 wherein the grout is a cement slurry injected through the bore at a pressure of at least 200 psi.

* * * * *